United States Patent [19]

Eastham et al.

[11] 4,032,810

[45] June 28, 1977

[54] ELECTROSTATIC ACCELERATORS

[75] Inventors: Derek Anthony Eastham, Macclesfield; Thomas Joy, Handforth, both of England

[73] Assignee: Science Research Council, London, England

[22] Filed: Sept. 5, 1975

[21] Appl. No.: 610,763

[30] Foreign Application Priority Data

Sept. 10, 1974 United Kingdom ..... 39514/74

[52] U.S. Cl. ..... 313/360

[51] Int. Cl.² ..... H05H 5/00

[58] Field of Search ..... 313/360, 361, 363; 250/398, 400, 396

[56] References Cited

UNITED STATES PATENTS

| | | | |
|---|---|---|---|
| 2,501,882 | 3/1950 | Trump et al. | 313/360 |
| 3,361,980 | 1/1968 | Kane | 313/360 X |
| 3,408,519 | 10/1968 | Etievant et al. | 313/360 |

*Primary Examiner*—Stanley T. Krawczewicz
*Attorney, Agent, or Firm*—Larson, Taylor and Hinds

[57] ABSTRACT

An accelerating tube for an electrostatic particle accelerator is composed of a plurality of rings of insulating material interleaved with annular metal discs. The discs are interconnected externally of the tube by resistor bridges in a manner to provide a decoupled zone somewhere along the potential gradient and within this zone particle trapping electrodes are placed to take out low energy particles near the periphery of the main beam with reduced secondary particle generation.

11 Claims, 16 Drawing Figures

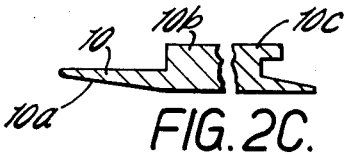
FIG. 2C.
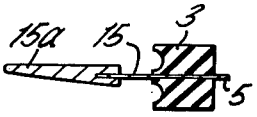
FIG. 2B.
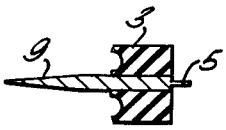
FIG. 2D.
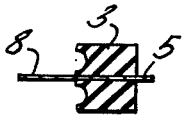
FIG. 2A.
FIG. 1.
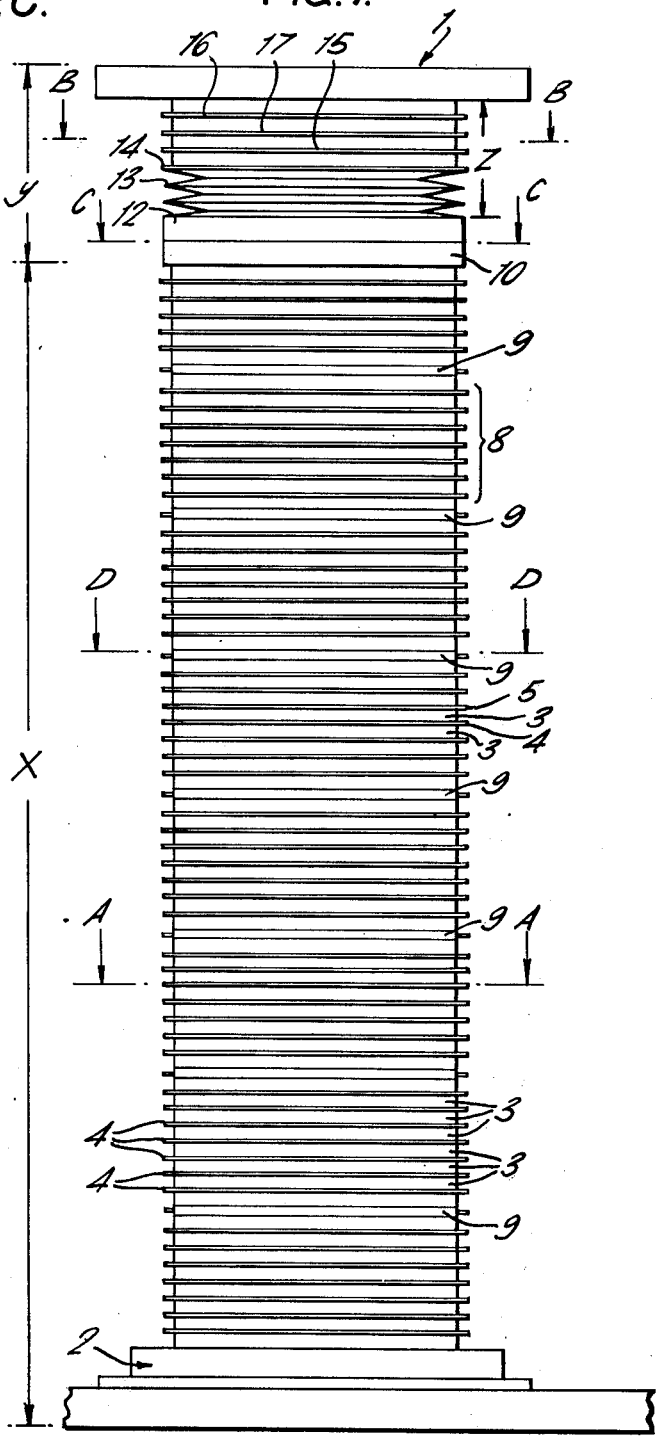

ELECTROSTATIC ACCELERATORS

BACKGROUND OF THE INVENTION

This invention relates to electrostatic particle accelerators and chiefly relates to evacuated accelerator tube assemblies for use in such accelerators. The accelerator tube assembly currently favoured comprises a stack of rings of insulating material eg glass or ceramic interleaved with and bonded to, annular metal electrodes, termed herein intermediate electrodes which, being located between a high voltage terminal and ground, are held at graded potentials by means of electrical resistance bridges (or otherwise) connected as potential dividers. Once a high voltage is applied to the terminal an electric field is established along the bore of the tube, the field being axially of the tube, and the potentials along the bore constitute a potential gradient down which particles may be induced to pass and to be accelerated in the process to high energies. In any accelerator tube assembly there may be found charged particles which may defeat efforts to produce a high efficiency tube by various mechanisms. As will be known, in the prior designs these unwanted particles have been taken out of the system by magnets or by trapping on specially provided electrodes which are reverse biased. Again the axial drift of these particles has been limited by employing narrowly apertured diaphragms. There remains yet still scope for improvement, however, and it is an object of the present invention to reduce the effect that these unwanted particles may have on tube efficiency.

More particularly the inventors have considered the effects on tube efficiency of randomly charged particles, or their successors, possibly being accelerated in counter current to the intended direction for a main particle beam, possibly with consequential scattering, and also of charge build up on the inuslator rings following collisions between particles and the tube structure.

SUMMARY OF THE INVENTION

According to the present invention an accelerating tube for an electrostatic particle accelerator is adapted in response to a voltage applied across the tube to support a potential gradient and so define a path for particles accelerated to high energies centrally of the tube, the tube having a discrete axially extending zone electrically decoupled from the potential gradient, the zone containing a particle trapping system including annular trapping electrodes coaxial with the tube and connected to exhibit different potentials to trap out particles at the periphery of said path. The decoupled zone tends to inhibit secondary particle emission from the trapping electrode as the latter traps low energy particles of appropriate sign. Trapping efficiency is thereby improved. When a potential difference is applied across the tube, the counter streaming of secondary particles deleterious to tube efficiency is obviated. The formation of a decoupled zone may be effected by connecting two spaced electrodes to a locally referred earth, or otherwise interrupting the potential gradient. Between these locally earthed electrodes a particle trapping electrode is positioned. The decoupled zone may comprise three axially spaced electrodes at local earth potential and two trapping electrodes of opposite sign are positioned one in each space between the local earth electrodes. The value of the potential applied across each of these trapping electrodes and local earth may be a convenient fraction of the potential difference between adjacent graded intermediate electrodes in the accelerating portion of the tube.

These decoupled zones have substantially no effect upon the energy of the accelerated beam of charged particles which occupies the central core of the tube.

The decoupling in the sense as used herein refers to the effect whereby the voltage gradient is locally interrupted by two or more intermediate electrodes deliberately held at constant and equal potentials so constituting for present purposes and referred to as local earth.

The effect of the decoupling and trapping zones for reducing charge build up on insulator surfaces (with the secondary effect of setting up transverse fields) may be increased according to a further feature of the invention by special profiling of the insulator surface.

According to this feature of the invention, in an accelerator tube assembly comprising a stack of rings of insulating material, interleaved with annular electrodes, the profile of the insulating material exhibits a pair of undercut annular grooves at positions where insulating material abuts the annular electrodes. The angle which the undercut surface in the insulating material makes with planes normal to the tube axis is carefully predetermined and lies within the range 60° ± 10°.

According to a still further feature of the invention, the surface of the insulant bounding the tube bore is profiled with an annular groove of arcuate or cusp shape. Such a groove may be employed together with the undercut annular grooves mentioned, the rims of the cusp shaped groove, in each case, being coincident with the edge of the undercut grooves.

DESCRIPTION OF THE DRAWINGS

In order that the invention may be better understood an accelerator tube incorporating the invention will now be described with reference to the accompanying drawings in which:

FIG. 1 is an elevation of an accelerator tube assembly, with the externally projecting spark rings omitted;

Figure 3:
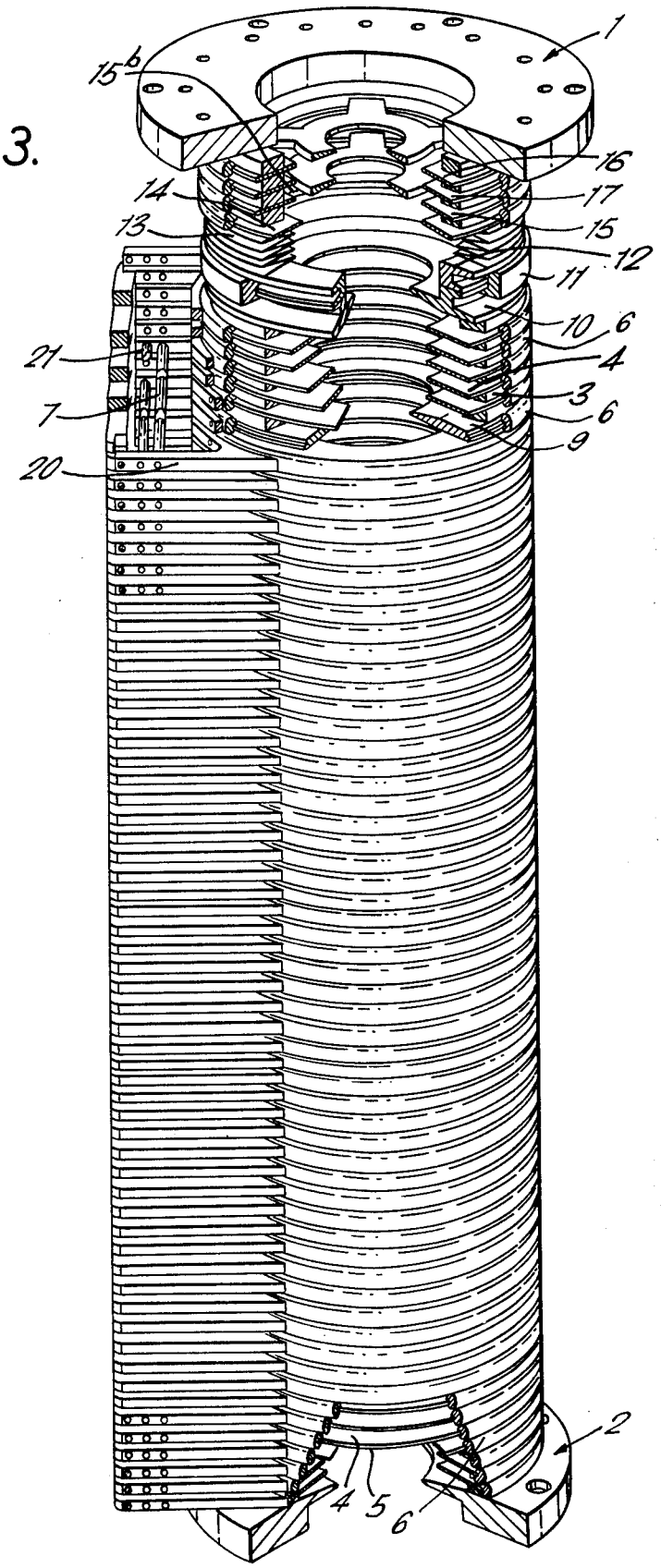
Figure 3A:
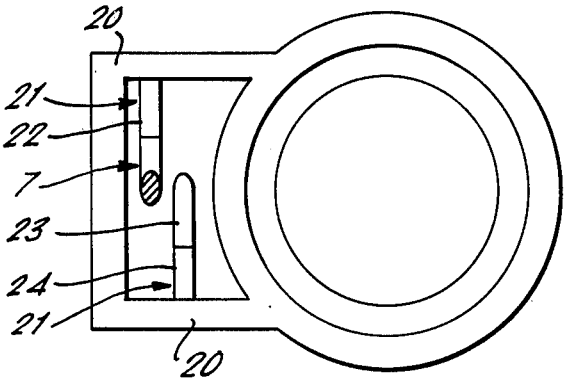
Figure 3B:
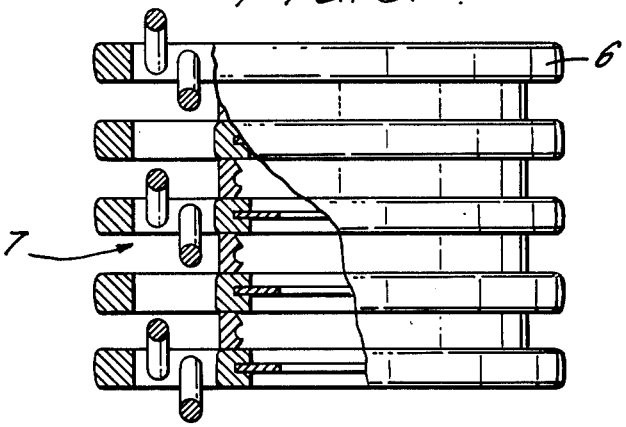
Figure 6:
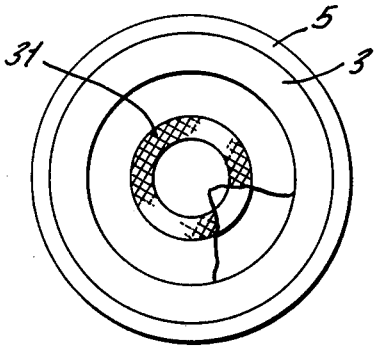
Figure 4:
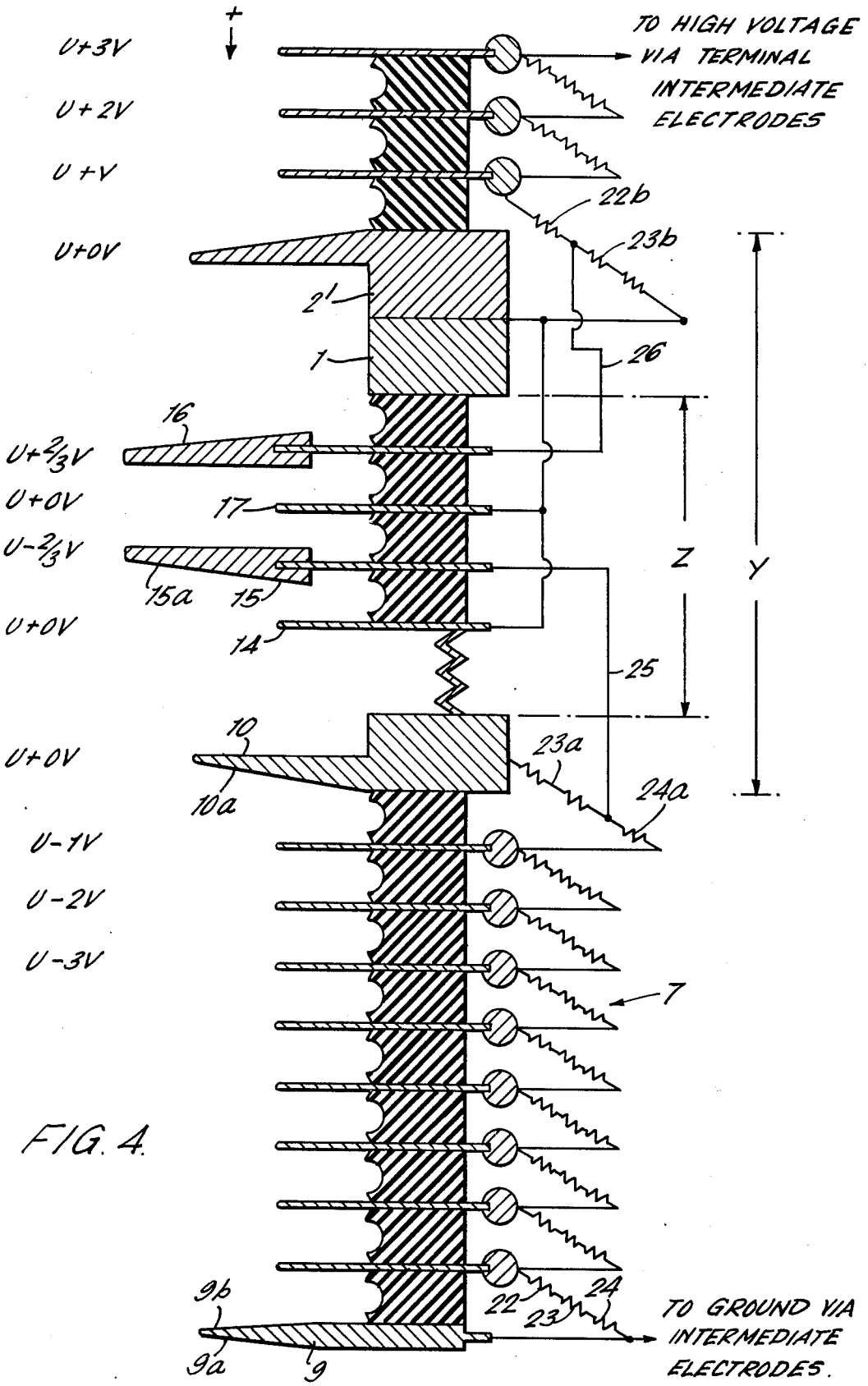
Figure 5:
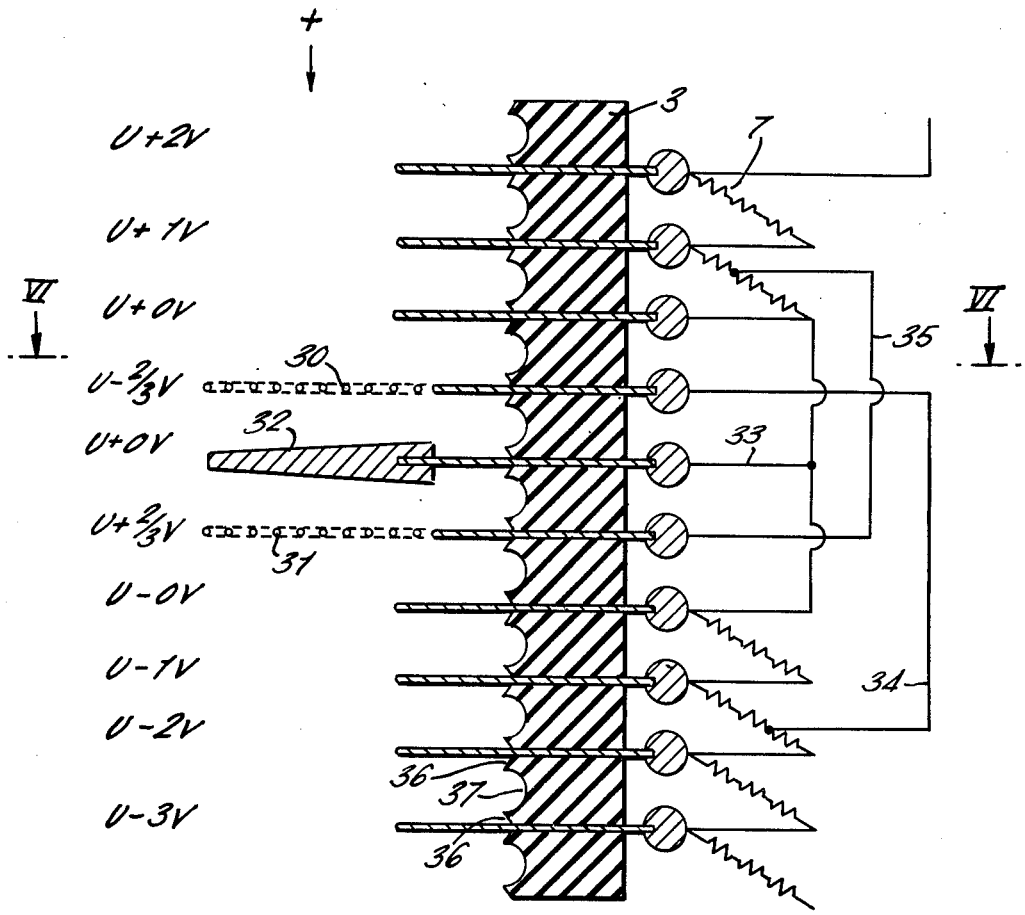

FIGS. **2*a*–2*d*** are cross-sections to an enlarged scale on lines *a—a* to *d—d* respectively of FIG. 1A–1D;

FIG. 3 is an isometric view of a tube partly cut away to show the interior;

FIGS. 3A–3B are views in plan and side elevation respectively of part of FIG. 3;

FIG. 4 is a diagram showing relative potentials across a decoupled zone as shown in FIG. 1;

FIG. 5 is a diagram similar to FIG. 4 showing a modified form of the invention;

FIG. 6 is a cross-section on the line VI—VI in FIG. 5, and

Figure 7:
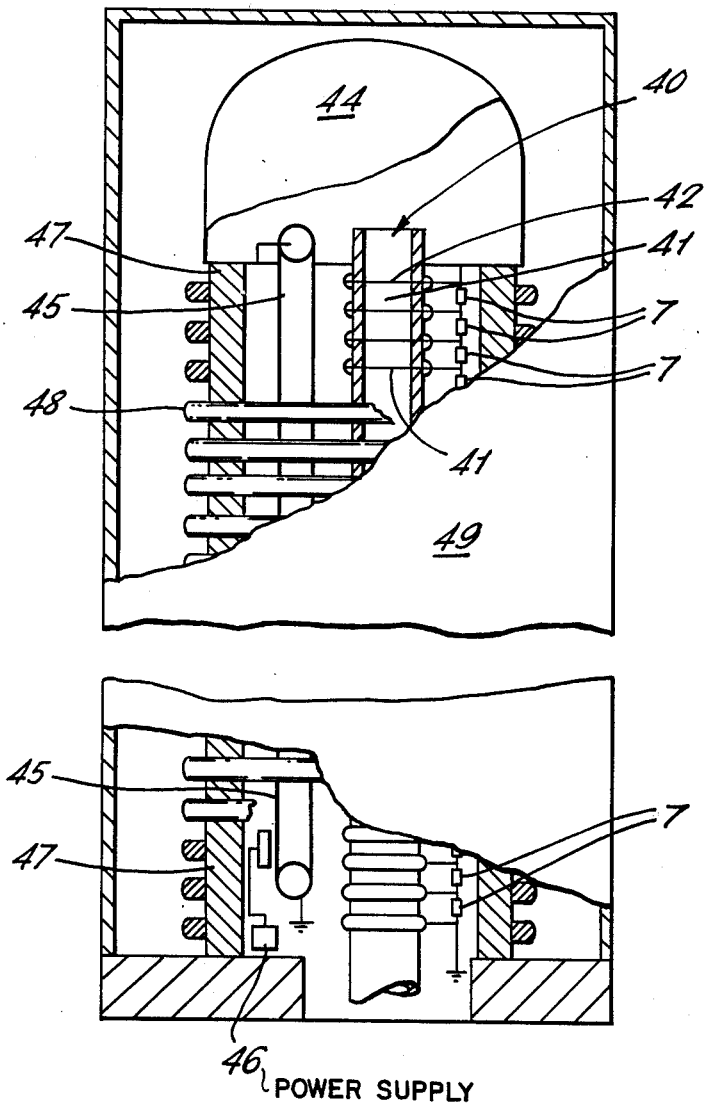

FIG. 7 is a diagram of an electrostatic particle accelerator.

DESCRIPTION OF THE PREFERRED EMBODIMENTS

An accelerator tube assembly according to one embodiment is built up by a number of tube modules one of which shown in FIG. 1. This comprises a pair of spaced flanges 1,2 between which is a stack of ceramic insulator rings 3 which are interleaved with annular metal electrodes 4. The electrodes 4 are bonded to the rings 3 and the latter to the flanges 1, 2 by a metallic interlayer of vacuum sealing standards. The electrodes 4, which are of titanium alloy in various specific shapes, all protrude from the exterior wall of the stack in a common exterior profile as shown at 5 where each is separately embraced by a spark ring 6 (FIG. 3). The rings 6 are coupled along one flank by potential divider resistor bridges 7 which ensure that in use a correct potential gradient exists along the tube length for the acceleration of particles. The particles which are generated from an ion source (not shown) mounted at the top of the tube are accelerated in known manner down the voltage gradient within the tube bore and are collimated for the most part into a high energy beam near the tube axis. As will be known, it is important to maintain a high vacuum standard within the tube bore with one object of facilitating the maintenance of a steep potential gradient and of facilitating the efficient transmission of heavy ions.

To facilitate operation without generating unwanted particle currents within the tube at least one zone of a tube module is decoupled from the remainder of the module by local earthed electrodes, the zone spanning a tube length containing a reverse biased electrode.

The internal profile of the insulator rings are specially shaped as will be explained below to reduce particle tracking along the surface. The tube module is divided into an active length $x$, and a decoupled length $y$ of and within the latter a particle trap $z$.

Figure 1A:
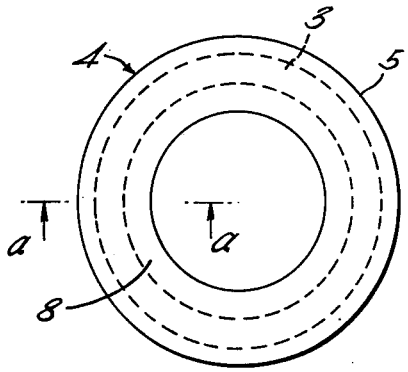
FIGS. 1A–1D are cross-sections in radial planes showing bore profiles at various position along the tube where intermediate electrodes of sundry shapes interleave the insulating rings.
Figure 1B:
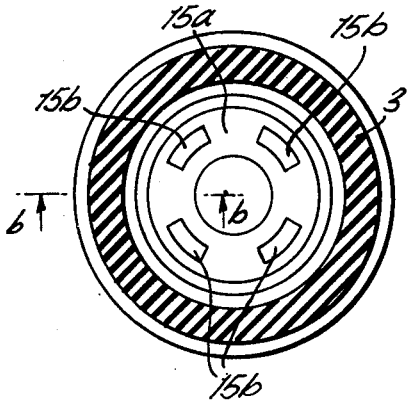
Figure 1C:
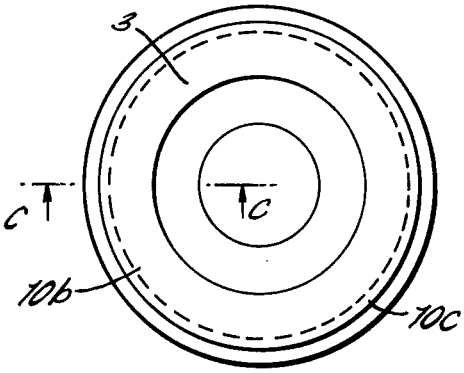
Figure 1D:
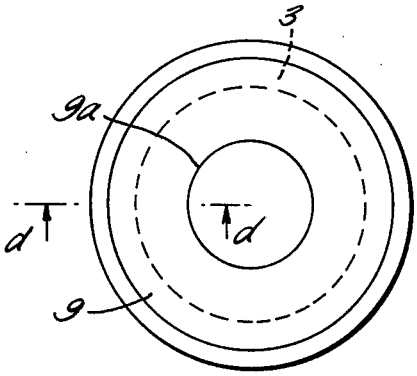

The active length $x$ comprises seven groups of intermediate electrodes shaped, as shown in FIG. 1A in plan and 2A in radial cross-section, as flat annular metal disc electrodes 8 projecting from between insulator rings 3 into the tube bore a fixed distance. After each seventh electrode 8, a tapered electrode 9 shaped as shown in FIG. 1D and 2D is employed.

The electrodes 9 have tapered faces within the tube bore and, having a smaller central hole 9*a*, tend to partially sub-divide the tube module bore into contiguous sections. Each section extends between the tapered faces 9*a* of adjacent electrodes 9 and between the tapered face 9*b* of the electrode 9 and the tapered face 10*a* of an electrode 10. The tapered faces 9*b*, 10*a* tend to direct particles towards the tube axis and away from the surface of the insulator rings. Hence charge build-up on the insulator surface is reduced and a high voltage may be sustained across each section (See FIG. 4). At the junction between the active zone $x$ and the decoupled zone $y$, a decoupling electrode 10 shaped as shown in FIG. 1C and FIG. 2C is used. Electrode 10 is connected to at a potential serving as a local earth point and has a central hole of diameter equal to that of the electrode 9 of FIG. 2D but in contrast has only one face 10*a*, ie that face directed towards the active zone $x$ of the tube module, of tapered profile. It is, moreover, integral with a thick metal flange 10*b* bonded to the adjacent ring 3. The outer periphery of electrode 10 which is best seen in FIG. 2c is provided with a clamping flange 10*c* by which it is clamped by a split clamping ring 11 to a distance piece 12. The latter is bonded to one end of a metal bellows 13, the other end of which is bonded to an electrode 14 of the shape shown at 8 in FIG. 2A. Electrode 14 is bonded to an insulator ring 3 which separates it from a reverse biased trapping electrode 15, shaped as shown in FIG. 2B, which one can see is essentially the same shape as the thin metal annular electrode shown in FIG. 2A but with the addition of a metal ring 15*a* on its inner periphery. As shown the ring 15*a* is tapered on one face only. The central aperture of the ring 15*a* is substantially smaller than any of the other electrode types consistent with its function as a trapping electrode. In order that its small hole does not restrict vacuum pumping of the tube interior four segment holes 15*b* are formed about the central hole. These are best seen in FIG. 3 and FIG. 1B. The trapping electrode 15 is one of an identical pair, the other one 16, also reverse biased, being separated from it by two insulator rings 3 which are interleaved by an electrode 17. Electrode 16 is the end electrode of the module and is insulated from the flange 1 by an insulating ring; the flange 1 being at local earth potential terminates the decoupled zone $y$.

FIGS. 3*a* and 3*b* show the spark rings 6 fitted over the externally protruding portions of the electrodes, appropriate spaces being left between adjacent spark rings. The intermediate electrodes along the entire active length are held at graded electrical potentials by a resistor bridge 7. To this end each spark ring detachably carries a separate rectangular frame 20. (FIGS. 3*a* and 3*b*) Adjacent frames 20 are coupled by a series of 3 metal oxide-ceramic film resistors indicated at 22, 23, 24 in FIG. 3*a* joined end to end to form a rod. The end connections of each series are connected electrically between adjacent upper and lower electrodes adjacent that frame via their respective spark rings. These and other electrical connections are best seen from FIG. 4 to which reference is made in the following description of the trapping system.

Considering FIG. 4 which shows an axial diagrammatic scrap view through the tube wall at the junction between two accelerating tube modules substantially as described with reference to FIG. 1 —FIG. 3, an arbitrary potential gradient has been inserted conveniently given by symbolic values from $u + 3v$ to $u - 3v$ where $u$ is some voltage value which occurs at this position along the voltage gradient in the tube and $v$ is the factor by which the potential of adjacent electrodes are graded. The portion of the tube considered spans a decoupled zone $y$ and also the junction between a lower flange 2′ of an upper tube module and an upper flange 1 of a lower tube module. Between flanges 2′ and 1 a bulkhead may be interposed. The value $u$ is the value in the overall potential gradient which occurs locally and is referred to as local earth.

Assume that the potential gradient is set up to accelerate positively charged particles along the tube bore from the top of the drawing. As shown the array of intermediate electrodes are interconnected by resistors, there being three resistors 22, 23, 24 between adjacent electrodes to preserve the potential gradient and give arbitrary steps of voltage of 1 $v$ between the electrodes.

However, the electrode 10 and flange 2′ define a decoupled zone $y$ both being at equal potentials of $u + ov$. Electrode 14 is also at $u + ov$. Small apertured electrodes 15, 16 are a pair of trapping electrodes respectively held at $u - \frac{2}{3}v$ and $u + \frac{2}{3}v$ to trap out particles at the periphery of the path. The electrode 15 is connected by conductor 25 to the junction between resistors 23*a* and 24*a* in the resistor bridge and electrode 16 is connected by conductor 26 to the junction between resistors 22*b* and 23*b*. It will be understood that the value $\frac{2}{3}v$ has been chosen as a typical value, but the value may be varied by the designer at will so long as the signs are maintained. Factors which the designer will take into account in making this choice would be eg the overall length of that trapping zone $z$ and the tube bore diameter. Between electrodes 15, 16 is electrode 17 held at $u + ov$, along with electrode 14 and flange 1.

The tube is pumped to a high vacuum standard and voltage applied. Even before any specific ion source is applied to the tube low energy positive and negative ions will almost certainly be present in the tube bore. These particles will be low energy particles which can interfere with the accelerating function of the tube. When such particles cross from one tube module towards the next and enter the decoupled zone, they will, if of positive sign, and at the peripheral region of the tube bore impinge on electrode 16 and their deposition will not displace a corresponding negatively charged particle due to the decoupled, or earthed, adjacent electrodes 14, 17; negative with respect to electrode 16. In a similar manner, a particle having negative charge wandering in the opposite sense into a decoupled zone passing the earthed electrodes 9, 14 will impinge upon trapping electrode 15. Again no positively charged particle is likely to be displaced from electrode 15 into the tube bore due to the decoupling effect of electrodes 17 and flange 1. Similar conditions are maintained in the presence of an accelerated ion beam with regard to low energy particles at the beam periphery which are thus trapped out.

A modified form of the invention is shown in FIGS. 5 and 6. In this modification the upper and lower apertured electrodes (15, 16) shown in FIG. 4 have been replaced by upper and lower annular wire grids 30, 31 of different polarity with respect to the positive ion flow direction to those associated with the electrodes 16, 15 in FIG. 4. The grids 30, 31 are respectively biased as indicated at $u \pm fv$ where f is a fraction of $v$ whose value is such that the potential of the grid causes a local field reversal adjacent the trapping electrode. With the fraction $f$ selected at ⅔ and the same relative polarities applied across the tube as a whole, ie strongly positive at the top, the upper grid 30 is charged $u - \frac{2}{3}v$ below local earth u and the lower grid 31 at $u + \frac{2}{3}v$. Between the two grids 30, 31 and separated therefrom by insulator rings is an annular trapping electrode 32 which is at a potential locally constituting earth by conductor 33. Conductors 34 and 35 connect wire grids 30, 31 to $u - \frac{2}{3}v$ and $u + \frac{2}{3}v$ points in the resistor bridge as shown. The trapping action of the electrode 32 is similar to that described with reference to FIG. 4. Positively charged particles which deposit upon the upper face of electrode 32 are not likely to displace any negatively charged particles from the electrode surface into the tube bore due to the local field set up by the grid 30 negative with respect to 32. Negatively charged particles colliding with the lower face of the electrode 32 are similarly bound without the release of a positively charged particle into the bore due to the influence of the positive field set up by the positively charged grid 31. In a further modification, both grids 30, 31 may be referred to earth potential that is $f = 0$. In this modification charged particles are bound to the surfaces of the electrode 32 merely because there is no field to encourage their displacement.

FIG. 4 and 5 indicate relative potentials only.

It will be seen that the rings of insulation material in radial cross-section are specially profiled as follows:

1. At each junction between the metal and the insulating ring 3 an undercut annular groove 36 is formed.

2. The groove 36 is undercut at an optimum angle of 60°. At this angle electrons generated in the corners do not set up accumulated surface charge areas on the insulant.

3. Between each adjacent pair of annular grooves a further annular groove 37 of arcuate shape is formed with re-entrant portions and extends in $x$-sections axially of the tube over 180° of arc, or thereabouts. This groove has the effect of reducing the electric field at the junction between the insulating ring 3 and the adjacent electrode; this junction is a normally a source of unwanted particles. It will be found that by thus profiling the face of the insulant local charge concentrations on the surface are less likely to occur.

In FIG. 7 the linear accelerator shown diagrammatically has an accelerating tube 40 composed of insulating rings 41 interleaved and bonded with intermediate metal electrodes 42. The latter are connected together electrically by resistance bridges 43, corresponding to those indicated at 7 in FIGS. 1, 4 and 5, the bridges maintain the overall voltage gradient along the tube and include the decoupled zone and trapping system as shown in FIGS. 4 or 5. The upper and lowermost resistance bridges are in electrical connection with adjacent structure, ie the terminal 44 and the base, more by nature of the construction than by design. However, the series of resistance bridges is of such a high value that any current, if any, in this path is negligible. The remainder of the accelerator is more or less conventional having the high voltage terminal 44 at the top which is charged by the operation of a charge conveyor 45. A power supply 46 allows the conveyor to acquire increments of charge and the conveyor transfers these to the terminal 44 where they are deposited to build up a high potential above earth. Electrostatic particles introduced from a source (not shown) into the terminal 44 may then be accelerated as a beam down the tube bore to high energies and the efficiency of the tube is enhanced by the action of the trapping system in taking out any low energy particles at the periphery of the beam with little secondary particle emission and the steering away of peripheral particles from possible impingement with the insulator rings 41. The rings 41 are shaped as shown in FIGS. 4 and 5 to reduce charge build up on their surfaces. The terminal 44 is supported by columns 47 composed of columnar blocks of insulation material having axially spaced spark rings 48. The accelerator including a charge generator are contained in a pressure vessel 49 for containing an atmosphere of electrically insulating gas.

What we claim is:

1. An accelerating tube for an electrostatic particle accelerator comprising a plurality of conductive metal ring-shaped electrodes and ring-shaped insulators bonded together alternately, an electrical resistor chain external to the tube, and interconnections between each electrode and the resistor chain, the resistor values being such that, in response to an electrical potential applied across the tube, a potential gradient exists along the tube, the tube having an axial portion thereof decoupled from said gradient, said axial portion being defined between a pair of spaced ring-shaped electrodes connected into the resistor chain by resistor values imparting equal potentials to said pair of electrodes, and a particle trapping means between said pair of spaced electrodes constituted by electrode means bearing a reverse bias potential with respect to the potential gradient.

2. An accelerating tube as claimed in claim 1 in which the particle trapping means comprises two ring-shaped electrodes of smaller internal diameter than other electrodes in the tube and connected electrically into the resistor chain so as to exhibit potentials respectively above and below said equipotential value.

3. An accelerating tube as claimed in claim 2 in which a further ring-shaped electrode at said equipotential value is interposed between the electrodes of smaller internal diameter and separated from them by insulators.

4. An accelerating tube as claimed in claim 2 in which the electrodes of smaller internal diameter are formed as grids.

5. An accelerating tube as claimed in claim 3 in which the electrodes of smaller internal diameter are formed as grids and interleaved by a ring-shaped electrode of similar internal diameter connected into the resistor chain to exhibit said equipotential, but separated from the grids by insulator rings.

6. An accelerating tube as claimed in claim 5 in which the interleaving electrode is tapered on both faces towards its inner periphery.

7. An accelerating tube as claimed in claim 1 in which the ring-shaped electrodes are connected into the resistor chain to exhibit on energisation equal increments along the potential gradient, and the potential between the particle trapping electrode and the adjacent electrodes is less than said increment.

8. An accelerating tube as claimed in claim 1 in which the ring-shaped insulators interleave the ring-shaped electrodes an exhibit profiles on their inner periphery which includes a pair of undercut annular grooves at positions where the insulators abut the ring-shaped electrodes.

9. An accelerating tube as claimed in claim 8 in which the angle which the undercut surface of each annular groove makes with planes normal to the tube axis lies within the range 50°–70°.

10. An accelerating tube as claimed in claim 9 in which the profile of the insulators in the tube bore includes an annular groove.

11. An accelerating tube as claimed in claim 10 in which the annular groove is smoothly curved with re-entrant portions.

* * * * *